US006164645A

United States Patent [19]

Weiss

[11] Patent Number: 6,164,645

[45] Date of Patent: Dec. 26, 2000

[54] GAMING MACHINE

[75] Inventor: Steven A. Weiss, Las Vegas, Nev.

[73] Assignee: Casino Data Systems, Las Vegas, Nev.

[21] Appl. No.: 09/395,635

[22] Filed: Sep. 14, 1999

[51] Int. Cl.[7] ..... A63B 71/00

[52] U.S. Cl. ..... 273/138.2; 273/143 R; 463/46; 463/20; 463/16

[58] Field of Search ..... 273/138.2, 143; 463/20, 16, 46; 248/917, 918, 919; 312/223.1

[56] References Cited

U.S. PATENT DOCUMENTS

| | | | |
|---|---|---|---|
| 4,084,194 | 4/1978 | Hector | 358/254 |
| 4,363,486 | 12/1982 | Chaudhry et al. | 273/143 B |
| 4,440,457 | 4/1984 | Fogelman et al. | 312/7.1 |
| 4,589,659 | 5/1986 | Yokoi et al. | 273/1 GC |
| 5,024,439 | 6/1991 | Okada | 273/143 R |
| 5,209,479 | 5/1993 | Nagao et al. | 273/143 R |
| 5,848,932 | 12/1998 | Adams | 463/20 |
| 6,012,982 | 1/2000 | Piechowiak et al. | 463/16 |

FOREIGN PATENT DOCUMENTS

| | | |
|---|---|---|
| 2262642 | 12/1991 | United Kingdom . |

*Primary Examiner*—Jeanette Chapman
*Assistant Examiner*—Dolores R. Collins
*Attorney, Agent, or Firm*—Bernhard Kreten

[57] ABSTRACT

A gaming device having a plurality of mechanical reels placed adjacent to a thin profile video display. The thin profile video display allows access to storage rearward thereof. The close relationship of the video display and reels allows a player to view both video display and the reels within one's field of vision.

7 Claims, 2 Drawing Sheets

GAMING MACHINE

FIELD OF THE INVENTION

The instant invention relates generally to gaming machines. More particularly the instant invention is directed to a gaming machine in which a thin profile video display is pivotally mounted within the gaming machine and positioned to overlie a plurality of mechanical reels in very close proximity thereto so that both the reels and video display reside in a viewer's normal field of vision.

BACKGROUND OF THE INVENTION

Once the player has embarked in the wagering process on a casino game, a successful game is one which maintains the interest of the player for a protracted period of time. Distractions which interrupt the player's concentration are counterproductive in attaining this goal. Because the casino environment is rich I both visual and auditory stimulus, its relatively easy to divert the attention span of a player from a machine on which the player is presently participating.

One manner of distraction takes the form of requiring the player to divert the player's visual scan from the machine presently being played to other areas of the same machine in order to glean additional information. For example, some games have a series of reels oriented at one central portion of the machine and a bonusing device at a vertical extremity. This requires the player of the machine to divert his/her gaze and frequently alter the angulation of his/her head in order to clearly view the bonusing opportunity. Such diversions break the rhythm if the player during the course of play and make the player susceptible to other visual stimuli in the casino environment.

In addition, the volumetric footprint of the machine, and not only just the surface area that it accommodates on the floor but also its visual height sometimes provides visual barriers that break up the panorama of the casino or diminish the machine density on the floor. Machine shortages are especially undesirable in times of heavy traffic.

In addition, the dimension of conventional video displays inside of a gaming machine consumes a considerable amount of space which could be better allocated for other uses.

SUMMARY OF THE INVENTION

The instant invention is distinguished over the known prior art in multiplicity of ways. In one aspect, the instant invention uses a low profile liquid crystal video display (LCD) which is dimensionally quite thin. One benefit from using such a thin display is that the portion rearward of such a display which heretofore had received the conventional, deeper video display now has been left vacant and can be used for the purposes. Another aspect of using a low profile LCD is that at least one peripheral side wall can be angled so that it is oriented immediately adjacent a plurality of mechanical reels such that the angled side lies almost tangent to the outer periphery of the annular reels which are serially oriented and collectively define a cylinder. By providing the side wall of the LCD display in close proximity to the reels, the field of player stimulus generated by the machine that is of primary importance to the player (i.e. the video display and the reels) are comfortably positioned within the normal field of vision of the player. This affords the player relative ease of viewing when regarding the device he is playing.

A corollary to providing a thin profile video display, as mentioned, allows storage rearwardly of the video display.

This is effected by supporting the video display on hinges preferably on one side of the housing which ensconces the machinery associated with the video game. Preferably, the video display hinge is near a hinge for a front door that allows access to the interior of the machine. By having the video display mounted on a hinge at the same side there of, the video screen can be rotated out of the box allowing access to the interior of the box where storage can be provided for other instrumentalities useful in the game, such as surplus coinage, other peripherals etc. Because the LCD mounts for rotation about a vertical axis, a special docking arrangement is associated with the LCD that allows power to be supplied to the LCD once the LCD is restored to its operative, closed position. More specifically, a latch and socket plug arrangement are provided on a side of the LCD remote from the hinge so that the LCD is automatically powered up upon latching the LCD back into its deployed condition within the housing.

OBJECTS OF THE INVENTION

Accordingly, it is a primary object of the present invention to provide a novel and useful gaming device featuring a low-profile video display.

A further object of the present invention is to provide a device as characterized above which allows a video display to be placed in very close proximity to a plurality of reel mechanisms and therefore within the normal viewing field of a user's normal field of vision.

A further object of the present invention is to provide devices characterized above where an access rearward of the LCD, heretofore preoccupied with a larger footprint display now has storage capability.

A further object of the present invention is to provide a device as characterized above in which the LCD is powered up by means of a plug socket on a side of the LCD remote from a vertically oriented hinge.

Viewed from a first vantage point, it is an object of the present invention to provide a gaming machine comprising, in combination, a housing defining a hollow interior and having a front rotatable panel which has first hinge means allowing access to a video means, said video means supported on second hinge means allowing rotation and exposing said hollow interior.

Viewed from a second vantage point, it is an object of the present invention to provide a plurality of mechanical reels mounted in an interior of a gaming machine, each reel of annular contour and oriented in side-by-side relationship such that collectively outer surfaces of said reels generally define a cylinder, and a video display having an angled surface placed adjacent said reels.

Viewed from a third vantage point, it is an object of the present invention to provide a video display having a substantially planar front and rear surfaces and a periphery extending between said surfaces including one peripheral side adjacent said reels, said one side having an angled wall spaced from said reels by a minimum clearance to still allow rotation of said reels but orienting said video display immediately adjacent said reels.

These and other objects will be made manifest when considering the following detailed specification when taken in conjunction with the appended drawing figures.

DESCRIPTION OF PREFERRED EMBODIMENTS

Figure 1:
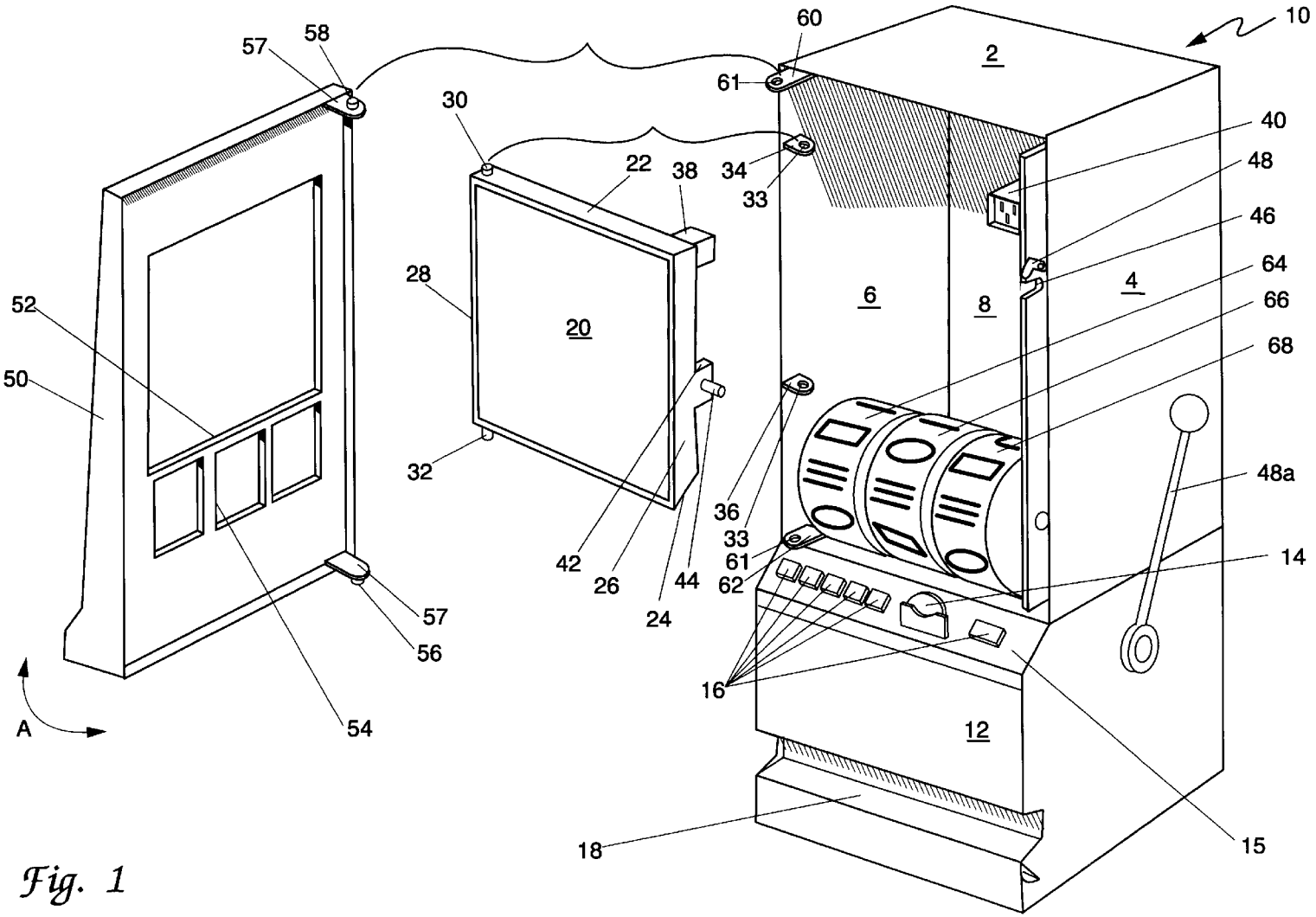
FIG. 1 is an exploded parts perspective of the apparatus according to the present invention.

Considering the drawings, wherein like reference numerals denote like parts throughout the various drawing figures, reference numeral 10 is directed to the gaming machine according to the present invention.

With respect to FIG. 1, the gaming machine 10 is shown as including a housing formed as a substantially rectangular box having a top 2, pair of spaced parallel sidewalls 4, 6, and a back wall 8. Sidewall 4 includes a lever/handle 48*a*. These walls are supported on a base 12 having similarly extending walls lying in planes coincident to the above identified walls. A front wall of the base 12 includes a ledge 15 that supports a plurality of decision making buttons 16 and includes means 14 for entering wagering instrumentalties such as coins, currency, cards or the like to enable the machine to operate based on credits in. A discharge hopper 18 dispenses wagering instrumentalties to the player upon quitting the game. The decision making button 16 typically includes means for making selections during the course of the game, and a button for betting one credit, a button for betting a maximum bet and a cash out button.

The housing is enclosed by means of a front panel 50 which is rotatable about a vertical axis defined as a line passing through an upper pivot pin 58, and a lower pivot pin 56, respectively projecting above and below an outwardly extending upper and lower tab 57. Each of the pivot pins 56, 58 reside within bores 61 located on outwardly projecting tabs 60, 62. Thus, the front panel 50 can rotate in an arc defined by the letter A shown in FIG. 1. The front panel includes an upper window 52 defined by an opening which exposes the video display 20 preferably configured of an LCD. In addition, immediately below the upper window 52 are a plurality of smaller windows 54 each of which register over one of a plurality of reels 64, 66, 68. The reels are in operative association such that each reel can move as is well-known in the art.

Figure 3:
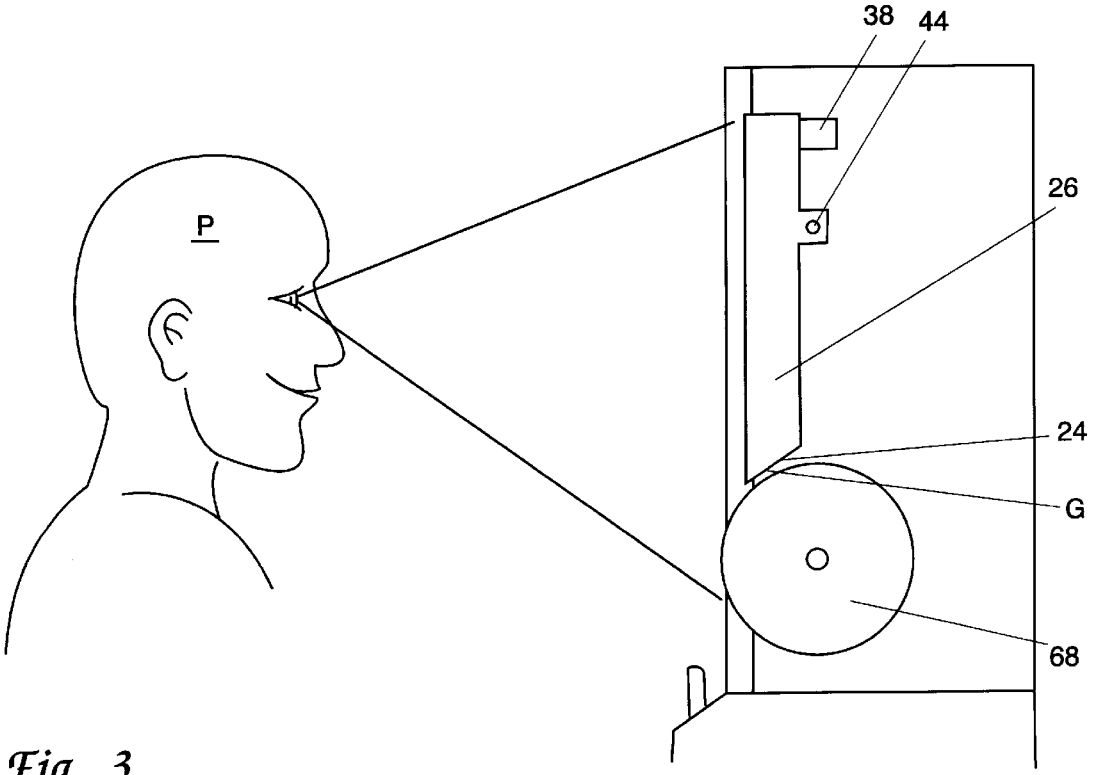
FIG. 3 is a side view partially in section showing one attribute of the instant invention.

FIGS. 1 and 3 reflect that the LCD includes a front surface and a rear surface which are circumscribed by a periphery having a top side 22, a pair of opposed sides 26, 28 and a bottom side 24. The LCD 20 can move about the same angle of rotation A by virtue of upper and lower projecting pivot pins 30, 32 residing within holes 33 of tabs 34 and 36. Thus, the video display 20 can move from an open position to a closed position. To facilitate closure, a horizontally extending pin 44 projects from the side 26 shown in FIG. 1 with the pin 44 supported on a rearwardly projecting tab 42. The pin 44 rests within a notch 46 formed within the interior of the housing and is secured within the notch 46 by means of a latch 48. In addition, a rear face of the video display 20 includes a plug member 38 which nests within a corresponding plug receiver 40 to provide electrical power and a signal to the display 20 so that the display 20 can provide visual information.

Figure 2:
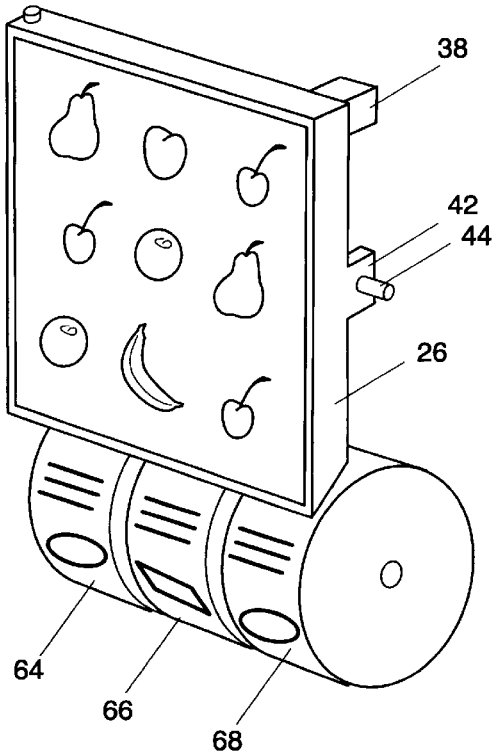
FIG. 2 is a perspective view of two features of the instant invention devoid of other structure for clarity and exposition.

FIGS. 2 and 3 reflect the relationship between the reels and the video display. As shown, the reels 64, 66, 68 are placed in very close registry with the bottom surface 24 of the video display. More specifically, the bottom surface 24 has an angled face that provides one acute and one obtuse angle with respect to the vertically oriented front and rear surfaces of the video display. The acute angle is located forward. As shown, a minimal gap G is provided between the reels and the bottom surface 24 such that if the bottom surface 24 were any closer, interference would exist between the operation of the reels and the bottom surface 24. Basically, the bottom surface 24 is on a line parallel to a tangent of the reels 68, 66 and 64 but spaced therefrom to prevent mechanical interference. Each reel includes an annular strip. Collectively the strips form a cylinder (with clearance between adjacent strips).

Also shown in FIG. 3 is a void rearward of the video display which heretofore has been occupied by the greater depth of a conventional video display. With this space having been freed, the space is now available for other storage, such as coins, coin bags or the like. Also shown in FIG. 3 is that the normal field of vision of a player P can encompass the topmost extremity of the video display and the lowermost extremity of the reel mechanism within the normal field of vision. Thus, the entire active game area can be viewed in one field of vision.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A gaming machine comprising, in combination:

a housing defining a hollow interior and having a front rotatable panel which has first hinge means allowing access to a video means, said video means supported on second hinge means allowing rotation and exposing said hollow interior.

2. A gaming machine, comprising in combination:

a plurality of mechanical reels mounted in an interior of said gaming machine, each reel of annular contour and oriented in side-by-side relationship such that collectively outer surfaces of said reels generally define a cylinder, and a video display having an angled surface placed adjacent said reels.

3. A gaming machine, comprising in combination:

a video display having a substantially planar front and rear surfaces and a periphery extending between said surfaces including one peripheral side adjacent said reels, said one side having an angled wall spaced from said reels by a minimum clearance to still allow rotation of said reels but orienting said video display immediately adjacent said reels.

4. The machine of claim 1 wherein said video display has a width less than a depth of said housing of said gaming machine allowing storage therebeyond.

5. The machine of claim 4 further including a plurality of mechanical reels mounted in an interior of said gaming machine, each reel of annular contour and oriented in side-by-side relationship such that collectively outer surfaces of said reels generally define a cylinder, and said video display having an angled surface placed adjacent said reels.

6. The machine of claim 5 wherein said angled surface is located on a lower periphery of said video display spaced a minimum clearance from said reels and oriented on a tangent therefrom.

7. The machine of claim 6 wherein said video display receives power from a plug on its rearward facing wall which mates with a plug in said housing, said plugs located adjacent a side of said video display remote from said hinge means.

* * * * *